US006065552A

United States Patent [19]

Scott et al.

[11] Patent Number: 6,065,552

[45] Date of Patent: May 23, 2000

[54] CUTTING ELEMENTS WITH BINDERLESS CARBIDE LAYER

[75] Inventors: Danny E. Scott, Montgomery; James L. Overstreet, Webster, both of Tex.

[73] Assignee: Baker Hughes Incorporated, Houston, Tex.

[21] Appl. No.: 09/119,574

[22] Filed: Jul. 20, 1998

[51] Int. Cl.[7] ..... E21B 10/00

[52] U.S. Cl. ..... 175/374; 175/431; 419/48; 228/3.1

[58] Field of Search ..... 175/426, 428, 175/431, 425, 336, 341, 374, 420.1; 501/87, 93; 419/48; 228/3.1

[56] References Cited

U.S. PATENT DOCUMENTS

| | | | |
|---|---|---|---|
| 4,341,557 | 7/1982 | Lizenby | 75/223 |
| 4,359,335 | 11/1982 | Garner | 175/379 X |
| 4,428,906 | 1/1984 | Rozmus | 419/48 |
| 4,656,002 | 4/1987 | Lizenby et al. | 419/10 |
| 4,722,405 | 2/1988 | Langford, Jr. | 175/374 |
| 4,744,943 | 5/1988 | Timm | 419/10 |
| 4,945,073 | 7/1990 | Dubensky et al. | 501/93 |
| 5,348,109 | 9/1994 | Griffin | 175/434 |
| 5,351,768 | 10/1994 | Scott et al. | 175/374 |
| 5,482,670 | 1/1996 | Hong | 419/15 |
| 5,542,485 | 8/1996 | Pessier et al. | 175/371 |

OTHER PUBLICATIONS

AH "Roctec Composite Carbides" Dow Chemical Company brochure; Date unknown.

*Primary Examiner*—Roger Schoeppel
*Attorney, Agent, or Firm*—Felsman Bradley Vaden Gunter & Dillon, LLP; James E. Bradley

[57] ABSTRACT

An earth-boring bit has cutting elements inserted within holes in the cutter support. The cutting element has a body of a fracture-tough material, preferably tungsten carbide which contains a binder of a soft metal. A layer of a composite carbide which is substantially free of a binder is attached to the cutting end of the body. One cutting element has a chisel-shaped cutting end with two flanks that converge. One of the flanks has the layer of binderless carbide. This insert is located at a junction between the gage surface and heel surface for engaging the sidewall of the bore. Also, gage inserts located in the gage surface have outer ends containing a layer of binderless carbide.

15 Claims, 3 Drawing Sheets

CUTTING ELEMENTS WITH BINDERLESS CARBIDE LAYER

TECHNICAL FIELD

This invention relates in general to earth-boring bits, and in particular to an earth-boring bit which has composite carbide cutting elements, at least some of the cutting elements having a binderless carbide layer on an exterior portion.

BACKGROUND ART

The success of rotary drilling enabled the discovery of deep oil and gas reservoirs. The rotary rock bit was an important invention that made rotary drilling economical. In drilling boreholes in earthen formations by the rotary method, rock bits fitted with one, two, or three rolling cutters are employed. The bit is secured to the lower end of a drill string that is rotated from the surface or by downhole motors or turbines. The cutters mounted on the bit roll and slide upon the bottom of the borehole as the bit is rotated, thereby engaging and disintegrating the formation material to be removed.

The roller cutters are provided with teeth or cutting elements that are forced to penetrate and gouge the bottom of the borehole by weight from the drill string. The cuttings from the bottom and sidewalls of the borehole are washed away by drilling fluid that is pumped down from the surface through the hollow drill string and are carried in suspension in the drilling fluid return to the surface.

One type of cutting element in widespread use is a cemented tungsten carbide insert which is interference pressed into an aperture in the cutter body or shell. Cemented tungsten carbide is a composite metal which is harder than the steel body of the cutter and has a cylindrical base portion and a cutting tip portion. The cutting tip portion is formed in various configurations, such as chisel, hemispherical or conical, depending upon the type of formation to be drilled.

Some of the cemented tungsten carbide inserts have very aggressive cutting structure designs and carbide grades that allow the bits to drill in both soft and medium formations with the same bit. These aggressive inserts are located in inner and heel rows which extend circumferentially around the cutter. The cutter also has a gage surface and a heel surface which is located at the outer edge of the inner rows and which joins the gage surface at an angle. Gage inserts are located on the gage surface to engage a sidewall of the borehole. In some cutters, scraper inserts are located at the junction between the heel surface and the gage surface for scraping the sidewall of the borehole.

During drilling high contact stresses and heat are generated, particularly by frictional engagement of the gage inserts and the scraper inserts with the borehole sidewall. Cemented tungsten carbide inserts contain a binder of a soft metal such as cobalt. Excessive heat can soften the binder, leading to plastic deformation of the insert under the high contact stresses common in drilling. The binder can also be chemically leached by the drilling fluids, or abraded away by the harder particles in the formation. All of the above conditions cause cracks to occur. These cracks can lead to premature failure. Composite carbides without binders are known, however, they are more brittle and thus subject to fracture more readily than a cemented carbide containing cobalt.

DISCLOSURE OF INVENTION

In this invention, an earth-boring bit has cutting elements secured with holes formed in a cutter shell or support. Some of the cutting elements have bodies formed of a fracture-tough material, preferably cemented tungsten carbide. This material contains soft metals such as cobalt or nickel as a binder and is sintered.

The body of the cutting element has a cutting end which protrudes from one of the holes. A layer of a binderless composite carbide is located on the cutting end. The layer is substantially free of binder. It is preferably formed on the cutting end of the body by a high pressure process.

BEST MODE FOR CARRYING OUT THE INVENTION

Figure 1:
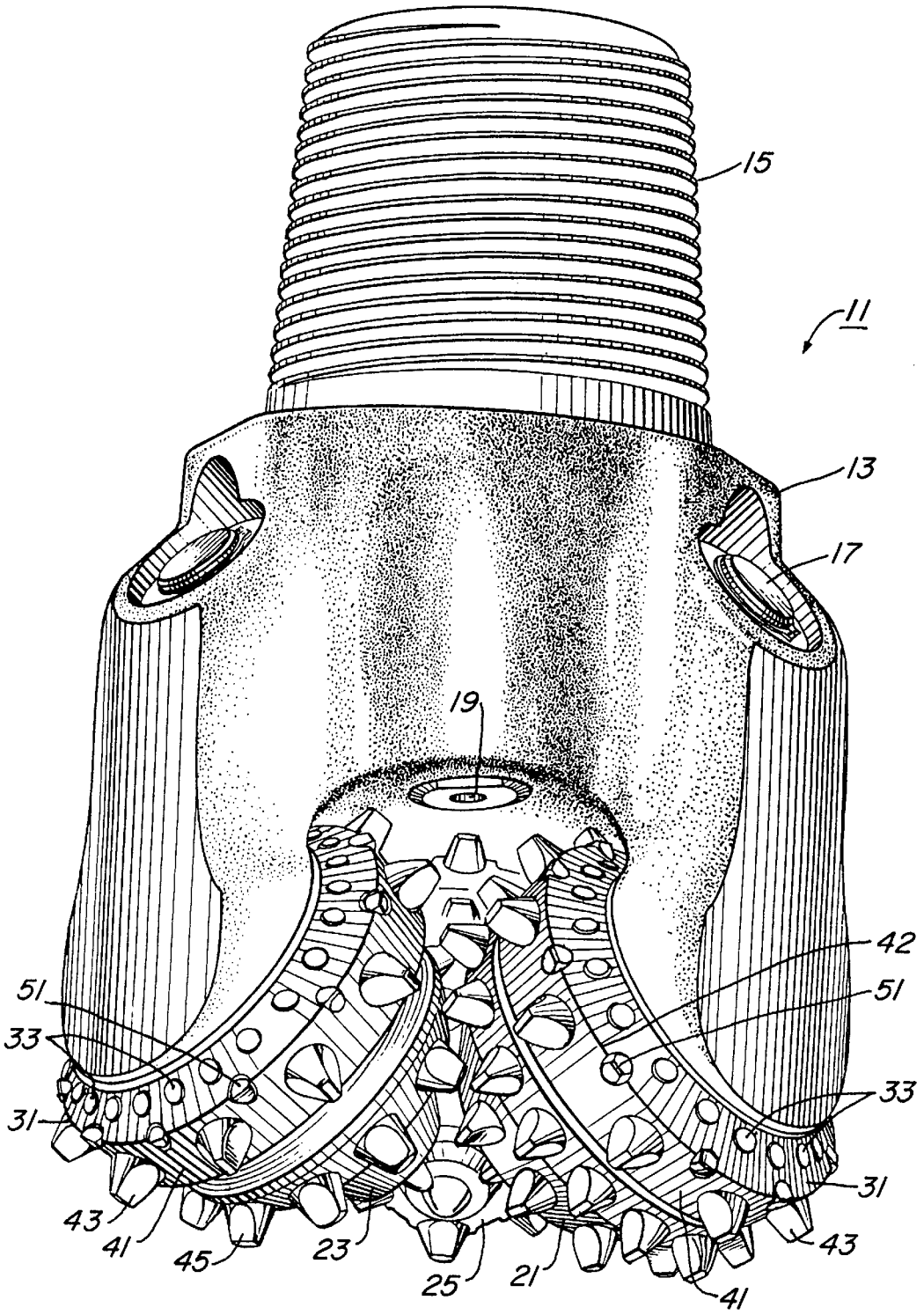
FIG. 1 is a perspective view of an earth-boring bit of the rolling cutter variety according to the present invention.

Referring now to the Figures and particularly to FIG. 1, an earth-boring bit 11 according to the present invention is illustrated. Bit 11 includes a bit body 13 which is threaded at its upper extent 15 for connection into a drill string. Body 13 has three legs, with each leg being provided with a lubricant compensator 17. At least one nozzle 19 is provided in bit body 13 to spray drilling fluid from within the drill string to cool and lubricate bit 11 during drilling operation. A cutter 21, 23, or 25 is rotatably secured to a bearing shaft which depends from each of the legs of bit body 13.

Each cutter 21, 23, 25 has an exterior surface including a gage surface 31 and a heel surface 41 which join each other at a junction 42. Each cutter 21, 23, 25 serves as a support for cutting elements. The cutting elements are arranged in generally circumferential rows on the cutter shell exterior surface and secured by interference fit. The cutting elements include gage cutting elements 33 secured within holes 34 (FIG. 6) on gage surface 31, heel cutting elements 43 on heel surfaces 41, and at least one inner row 45 of cutting elements. Heel cutting elements 43 may be conventional and the same as inner row elements 45. Gage trimmer or scraper elements 51 are mounted in holes 50 (FIG. 6) generally at junction 42 of gage 31 and heel 41 surfaces as disclosed in commonly assigned U.S. Pat. Nos. 5,351,768 and 5,479,997 to Scott et al.

Figure 2:
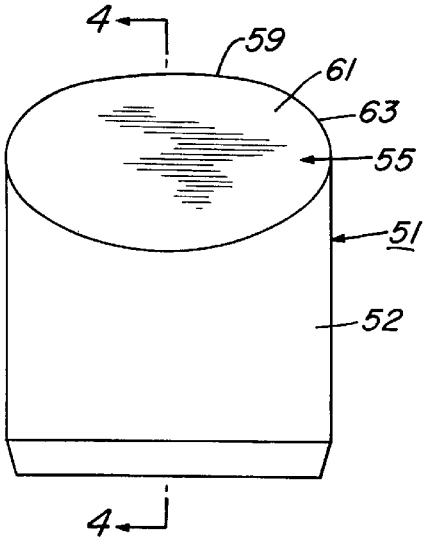
FIG. 2 is an elevational view of a first embodiment of an improved cutting element according to the present invention.
Figure 3:
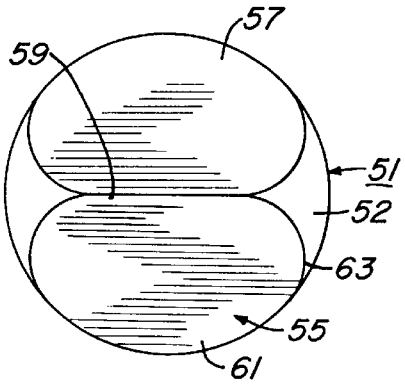
FIG. 3 is a top plan view of the cutting element of FIG. 2.
Figure 4:
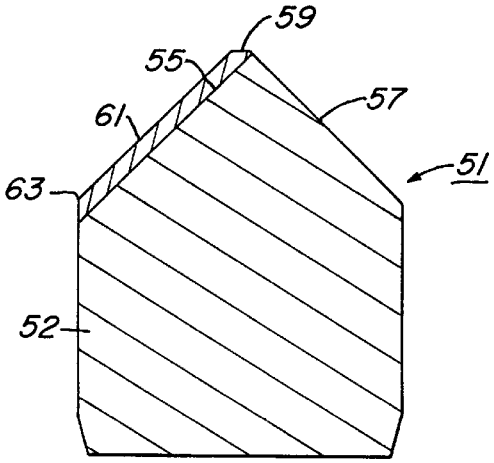
FIG. 4 is a sectional view of the cutting element of FIG. 2, taken along the line 4—4 of FIG. 2.
Figure 6:
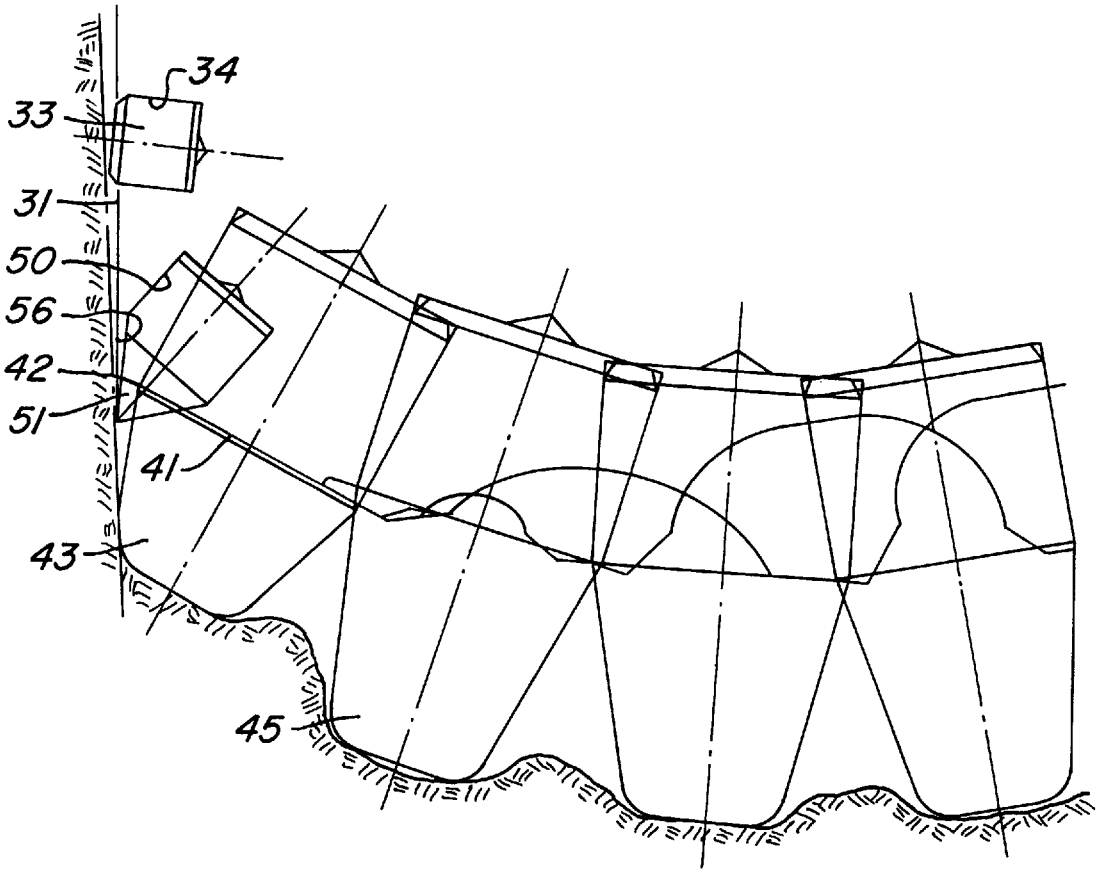
FIG. 6 is a partial schematic sectional view of a cutter for the bit of FIG. 1, illustrating locations for the cutting elements of FIGS. 2 and 5.

Referring to FIG. 2, each scraper insert 51 has a body 52 with a cylindrical base which is pressed by interference fit into one of the holes 50 (FIG. 6). Body 52 of scraper insert 51 has a cutting end which protrudes from hole 50 and is generally chisel-shaped. The cutting end includes an outer flank 55 which is flat and faces outwardly for engaging sidewall 56 (FIG. 6) of the bore. An inner flank 57 which is flat converges toward outer flank 55. A crest 59 is located at the intersection of flanks 55, 57. As shown in FIG. 2, outer flank 55 has a generally oval-shape perimeter 63. Inner flank 57 inclines at the same angle as outer flank 55 relative to the axis of body 52 and has a similar periphery.

Body 52 of scraper insert 51 is formed of a fracture-tough material, preferably a cemented carbide. The cemented carbide body 52 contains as a binder a soft metal such as cobalt, nickel, iron, or their alloys. Body 52 preferably has a hardness of approximately 89.0 HRA (Rockwell "A"). A preferred composite carbide material is tungsten carbide and has a binder of cobalt that is within the range of 6 to 16 percent. This material is commonly used for cutting elements in prior art bits.

A layer 61 of a binderless carbide is formed on outer flank 55. Layer 61 is a composite carbide material that has a much higher hardness than body 52, such as approximately 98.0 HRA. However, the fracture toughness of layer 61 is low compared to the material of body 52. The grain size of layer 61 is very fine compared with the grain size of the material of body 52, having a 0.25 microns average diameter. Layer 61 is about 0.030 to 0.100 inch in thickness and is flat. The preferred binderless carbide material for layer 61 consists essentially of tungsten carbide containing only a small amount of molybdenum. The materials and the process for manufacturing the material are known and are described in U.S. Pat. Nos. 4,744,943 and 4,945,073. One source of material for layer 61 is marketed by the Dow Chemical Company, Midland, Mich.

To apply layer 61, first body 52 will be formed in a conventional manner. During forming, a shallow recess or slot may be provided on outer flank 55 bounded by periphery 63. Then, layer 61 will be placed in the shallow recess on body 52 and bonded in a high pressure application. A preheated fluid die containing a preformed binderless carbide element and preformed body 52 is immersed in a forging press and pressure is applied to the fluid die. The pressures are quite high with short dwell times in order to densify layer 61 onto body 52 without affecting body 52. This process bonds layer 61 to body 52. Very little alloying between layer 61 and body 52 occurs.

Figure 5:
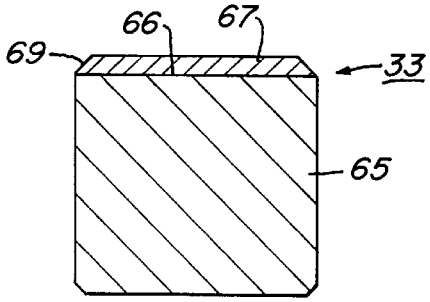
FIG. 5 is a sectional view of a second embodiment of an improved cutting element according to the present invention.

FIG. 5 shows a sectional view of one of the gage inserts 33. Gage insert 33 has a body 65 which is cylindrical. Body 65 is press fit within one of the holes 50 (FIG. 6). Body 65 has an outer end 66 which is flat and normal to the longitudinal axis of body 65. Body 65 is formed of a conventional cemented tungsten carbide having a binder of a soft material such as nickel or cobalt. Preferably, the tungsten carbide contains about 6 to 16 percent cobalt.

A layer 67 of a binderless carbide is formed on outer end 66. Layer 67 is of the same type and is applied in the same manner as layer 61 on scraper insert 52. Layer 66 has a bevelled cutting face 69 at an edge which adjoins body 65. Cutting face 69 is preferably inclined as described in U.S. Pat. No. 5,655,612.

In operation, scraper cutting elements 51 and gage cutting elements 33 will engage the borehole sidewall 56 (FIG. 6) in a scraping action. High frictional resistance, contact stresses, and thus heat are encountered by cutting elements 51 and 56. Binderless carbide layers 61 and 66 retard damage to the elements 51 and 33. Cutting face 69 of gage inserts 33 enhances the scraping action of the sidewall 56. The peripheries 63 of scraper inserts 51 maintain a sharp edge on layer 61 at crest 59 because of more wear occurring at the lip formed by periphery 63 with softer body 52 than on layer 61.

The invention has significant advantages. The binderless carbide layers on the scraper and gage inserts are more resistant to high temperatures than the cemented tungsten carbide bodies and thus less likely to develop cracks. The binderless layers are harder than the insert bodies, providing better sliding wear resistance than conventional tungsten carbide inserts.

While the invention has been shown in only two of its forms, it should be apparent to those skilled in the art that it is not so limited, but is susceptible to various changes without departing from the scope of the invention.

I claim:

1. An earth boring bit, comprising:

a bit body;

at least one cutting element support on the bit body;

a plurality of cutting elements secured within holes formed in the cutting element support;

at least one of the cutting elements comprising a cutting element body formed of fracture-tough material, the cutting element body having a cutting end which protrudes from one of the holes; and a layer of composite carbide which is substantially free of a metal binder and is attached to the cutting end.

2. The earth boring bit according to claim 1, wherein the cutting end has at least one flank which is substantially flat, and wherein the layer is located on the flank.

3. The earth boring bit according to claim 1, wherein the cutting end has two flanks which are substantially flat and converge toward each other, and wherein the layer is attached to one of the flanks.

4. The earth boring bit according to claim 1, wherein the cutting element body has an axis, the cutting end has an outer end which is substantially perpendicular to the axis, and the layer is attached to the outer end.

5. The earth boring bit according to claim 1 wherein the fracture-tough material is cemented tungsten carbide having a binder of a soft metal.

6. An earth boring bit, comprising:

a bit body;

at least one cantilevered bearing shaft depending inwardly and downwardly from the bit body;

a cutter mounted for rotation on the bearing shaft, the cutter having a heel surface and a gage surface which join each other;

a plurality of cutting elements secured within holes formed in the cutter;

at least one of the cutting elements comprising a cutting element body formed of fracture-tough material, the cutting element body having a cutting end which protrudes from one of the holes; and a layer of binderless composite carbide which is attached to the cutting end.

7. The earth-boring bit according to claim 6, wherein said at least one of the cutting elements is a scraper cutting element located in one of the holes at a junction between the gage surface and the heel surface, the scraper cutting element having inner and outer flank surfaces converging to define a crest which is in general alignment with the junction, and wherein the layer is attached to the outer flank surface.

8. The earth-boring bit according to claim 6, wherein said at least one of the cutting elements is a gage cutting element secured in one of the holes in the gage surface, the body of the gage cutting element having a longitudinal axis, the cutting end of the gage cutting element having an outer end substantially normal to the axis, and wherein the layer is attached to the outer end.

9. The earth-boring bit according to claim 6, wherein said at least one of the cutting elements is a gage cutting element secured in one of the holes in the gage surface, the body of the gage cutting element having a longitudinal axis, the cutting end of the gage cutting element having an outer end substantially normal to the axis, and wherein the layer is attached to the outer end, the layer having a bevelled cutting surface on an edge for shearing a sidewall of the borehole.

10. The earth boring bit according to claim 6 wherein the fracture-tough material is cemented tungsten carbide containing a binder from the group consisting of cobalt, nickel, iron, and their alloys.

11. An earth boring bit, comprising:

a bit body;

at least one cantilevered bearing shaft depending inwardly and downwardly from the bit body;

a cutter mounted for rotation on the bearing shaft, the cutter having a heel surface and a gage surface which join each other;

a plurality of cutting elements secured within holes formed in the gage surface and generally at a junction between the heel surface with the gage surface;

at least one of the cutting elements comprising a cutting element body formed of cemented tungsten carbide having a binder of a soft metal, the cutting element body having a cutting end which protrudes from one of the holes; and a layer of a composite carbide on the cutting end, the layer being substantially free of a binder of soft metal.

12. The earth-boring bit according to claim 11, wherein said at least one of the cutting elements is a scraper cutting element located in one of the holes at the junction, the scraper cutting element having inner and outer flank surfaces converging to define a crest which is in general alignment with the junction, and wherein the layer substantially covers the outer flank surface.

13. The earth-boring bit according to claim 12, wherein said at least one of the cutting elements is a scraper cutting element located in one of the holes at the junction, the scraper cutting element having inner and outer flank surfaces converging to define a crest which is in general alignment with the junction, and wherein the layer substantially covers the outer flank surface.

14. The earth-boring bit according to claim 12, wherein said at least one of the cutting elements is a gage cutting element secured in one of the holes in the gage surface, the body of the gage cutting element having a longitudinal axis, the cutting end of the gage cutting element having an outer end substantially normal to the axis, and wherein the layer substantially covers the outer end of the gage cutting element.

15. The earth-boring bit according to claim 11, wherein said at least one of the cutting elements is a gage cutting element secured in one of the holes in the gage surface, the body of the gage cutting element having a longitudinal axis, the cutting end of the gage cutting element having an outer end substantially normal to the axis, and wherein the layer substantially covers the outer end, the layer having a cutting face which is on an edge for shearing a sidewall of the borehole.

* * * * *